United States Patent [19]

Lench et al.

[11] 4,030,844

[45] June 21, 1977

[54] ROLL-ON DISPENSER BOTTLE ASSEMBLY

[75] Inventors: Jack Lench, West Babylon; Luigi M. Ferrari, Douglaston, both of N.Y.

[73] Assignee: Del Laboratories, Inc., Farmingdale, N.Y.

[22] Filed: Dec. 2, 1975

[21] Appl. No.: 636,915

[52] U.S. Cl. ..... 401/213
[51] Int. Cl.[2] ..... B43K 7/00
[58] Field of Search ..... B43K/9/00; 401/213

[56] References Cited

UNITED STATES PATENTS

| | | | |
|---|---|---|---|
| 2,700,784 | 1/1955 | De Brock | 401/213 |
| 2,749,566 | 6/1956 | Thomas | 401/213 |
| 2,997,731 | 8/1961 | Schultz | 401/213 |
| 3,090,987 | 5/1963 | Ruekberg | 401/213 |
| 3,137,886 | 6/1964 | De Groft | 401/213 |

FOREIGN PATENTS OR APPLICATIONS

| | | | |
|---|---|---|---|
| 270,136 | 11/1950 | Switzerland | 401/213 |

*Primary Examiner*—Lawrence Charles
*Attorney, Agent, or Firm*—Kirschstein, Kirschstein, Ottinger & Frank

[57] ABSTRACT

A roll-on dispenser bottle for dispensing cosmetics, deodorants, and the like, in which a plastic ball is mounted in the mouth of a glass bottle and a separate resilient ball retainer is provided which extends from the neck of the bottle. A cap also is provided which contains an insert having a protuberance and a shoulder or shelf which act to constrict the retainer on the ball and press the ball into a seat in the mouth of the bottle when the cap is firmly in place on the neck of the bottle, so as to provide positive closure when the bottle is not in use.

5 Claims, 4 Drawing Figures

ROLL-ON DISPENSER BOTTLE ASSEMBLY

BACKGROUND OF THE INVENTION

1. Field of the Invention

The invention relates to liquid dispensers of the roll-on type, in which a plastic ball mounted in the mouth of a glass bottle serves to dispense a controlled amount or film of liquid or paste in the bottle, by the well-known procedure of disposing the bottle at an angle to the vertical, or upside down, and rubbing or rolling the ball against a surface which is to receive the liquid.

2. Description of the Prior Art

Numerous types of prior art roll-on liquid dispenser bottles have been proposed. Many prior art configurations present a one-piece molded bottle body with the ball mounted in the mouth of the bottle. Other prior art bottles entail the provision of an insert which extends into the mouth of the bottle, with the ball mounted in the insert. Among the abundance of prior art disclosures may be mentioned U.S. Pat. No. 2,749,566.

SUMMARY OF THE INVENTION

Brief Description of the Invention

In the present invention, the roll-on dispenser bottle assembly is characterized by the provision of a retainer which extends from the mouth of the bottle to hold a synthetic plastic ball in place. The retainer preferably is mounted on the mouth of the bottle by providing an inner annular groove at one end of the retainer which engages an outwardly extending flange at the mouth of the bottle. The other end of the retainer is provided withe a substantially frusto-conical extension having an inwardly directed flexible lip which is adjacent the ball and which has a diameter less than the diameter of the ball, so that the ball cannot fall out of the mouth of the bottle.

A closure cap is also provided for the bottle. The cap has a skirt that has an inner female thread that cooperates with a male thread on the neck of the bottle. The cap may be unitary, however the cap preferably is provided with an insert characterized by a crown having a protuberance which presses the ball into the mouth of the bottle, and a skirt which has a lower frusto-conical surface that contacts the outer frusto-conical surface of the other end of the retainer and thus constricts the flexible retainer lip against the ball to thus seal the bottle mouth against liquid leakage when the cap is in place, both by pressing the ball as mentioned supra and also by compressing the lip inwards and downwards against the ball. Thus, positive sealing against liquid leakage or flow is achieved when the closure cap is in place.

When the closure cap is removed and the dispenser bottle is in service, the ball rotates freely within its mounting and serves to dispense a liquid or paste film on the ball in the usual manner. The contents of the bottle may be of the usual types sold for application to the surface or skin of the human body, e.g. cosmetics such as lipstick, kissing gloss, liquid make-up, or the like; or deodorant, perfume, cologne, etc.

The dispenser bottle assembly of the present invention provides several salient advantages. When the closure cap is in place, positive sealing and closure is attained as the cap insert skirt presses and constricts the flexible retainer lip against the ball. Further closure sealing is attained as the central protuberance presses the ball downwards into the mouth of the bottle. In prior art configurations, reliance for sealing is placed on the contact between the ball and the glass bottle mouth, however glass bottles cannot be manufactured with close tolerances while plastic components such as the coacting ball and lip have better tolerances and more precise dimensions, and since in the present invention principal reliance for sealing is based on the constriction of the flexible and resilient retainer lip against the ball, when the cap is in place, it has been determined that leakage or other loss of liquid or paste, or evaporation of a volatile liquid, are effectively prevented.

PURPOSES OF THE INVENTION

It is an object of the present invention to provide an improved roll-on dispenser bottle assembly.

Another object is to provide a roll-on dispenser bottle assembly with a closure cap in which the cap configuration in cooperation with a ball retainer attains positive sealing of the assembly against liquid leakage when the cap is in place.

Still a further object is to provide a roll-on dispenser bottle the parts of which are readily assembled in commercial production.

These and other objects and advantages of the present invention will become evident from the description which follows.

BRIEF DESCRIPTION OF THE DRAWINGS

Referring now to the drawings.

DETAILED DESCRIPTION OF THE PREFERRED EMBODIMENTS

Figure 1:
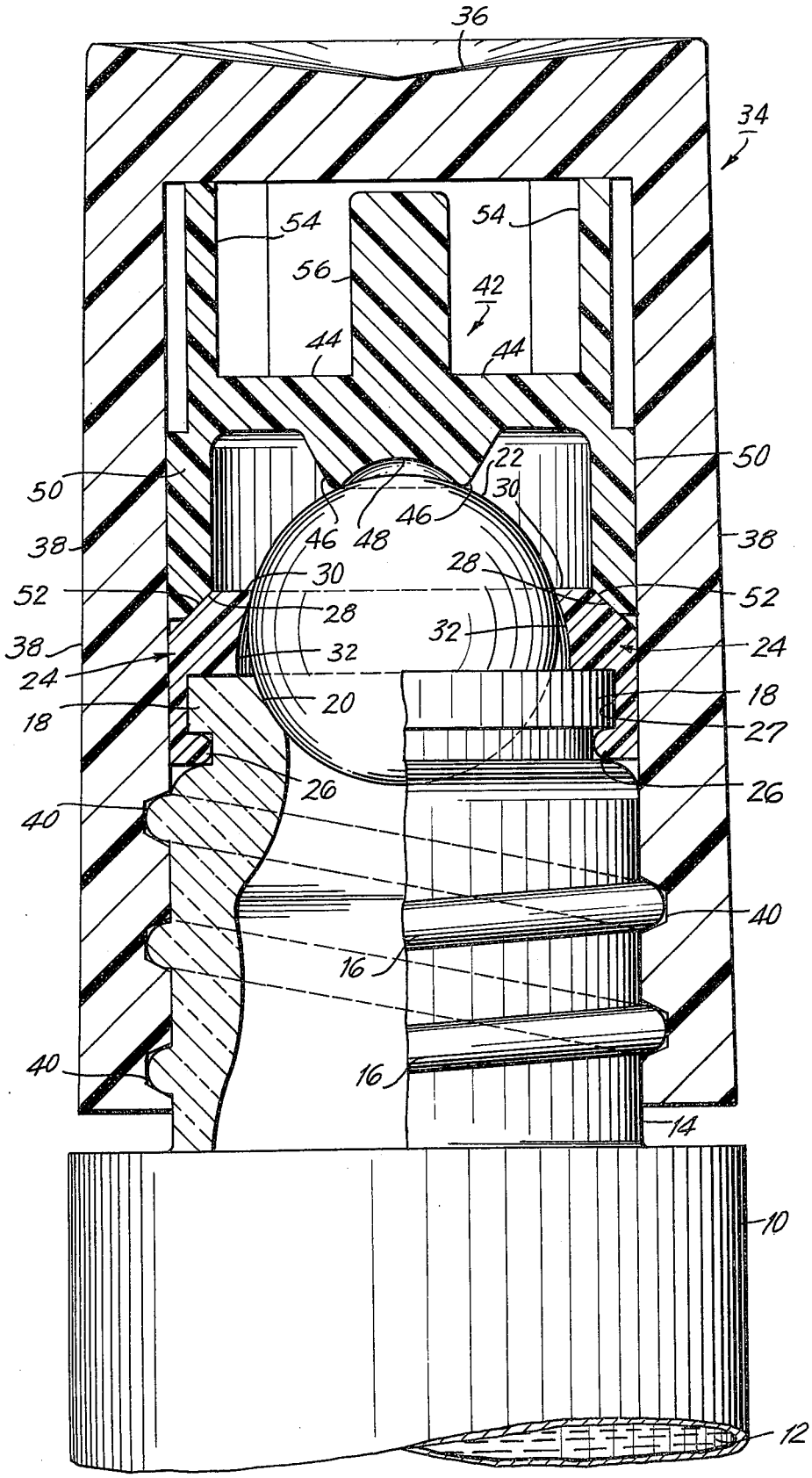
FIG. 1 is an axial sectional elevation view of a preferred embodiment of the roll-on dispenser bottle assembly with the closure cap in place.
Figure 2:
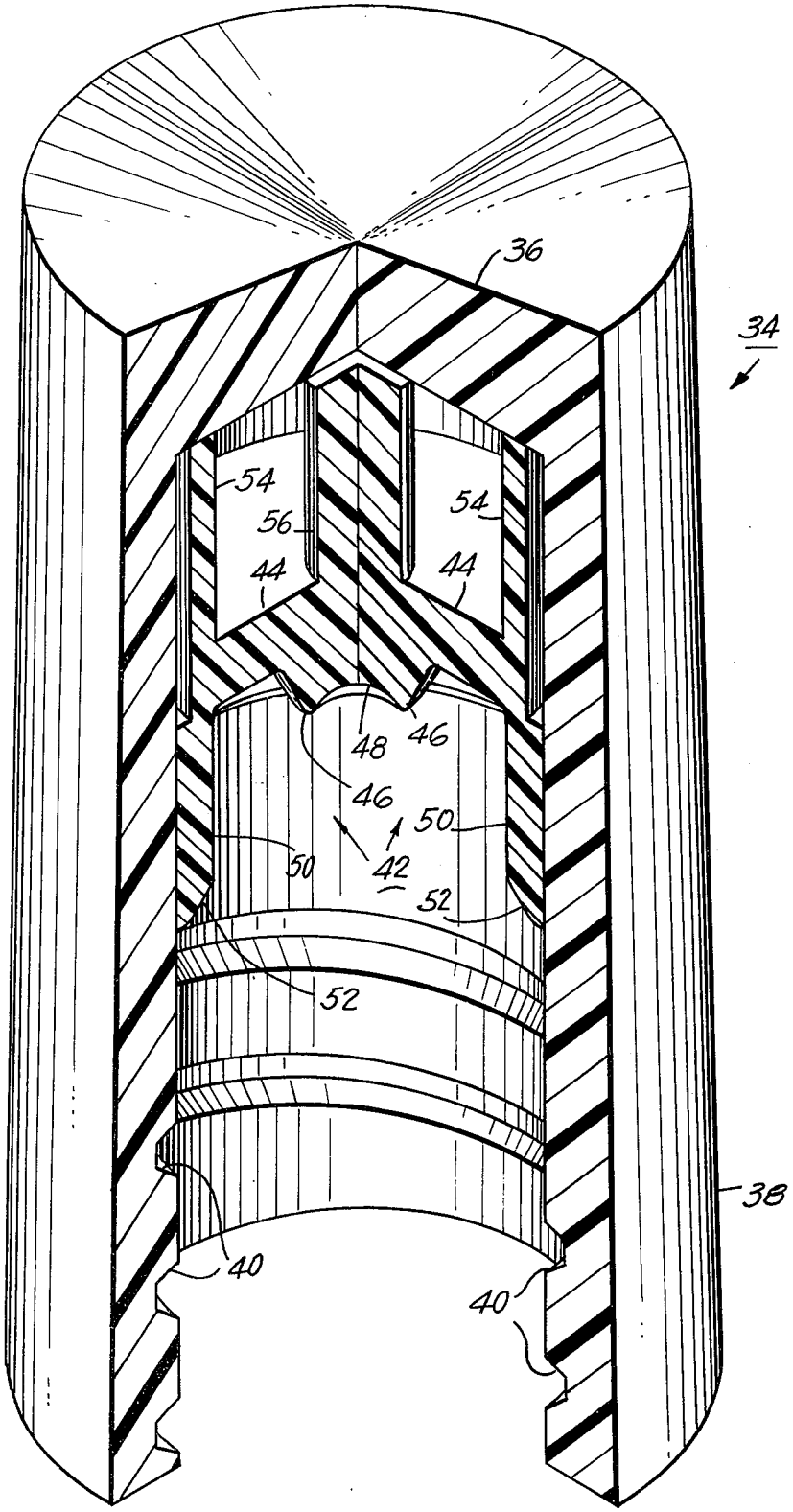
FIG. 2 is a sectional perspective view of one embodiment of the closure cap.

Referring now to FIG. 1, a glass bottle 10, typically of cylindrical configuration although this only exemplification, is provided with a filling of dispensable contents 12, which may be any suitable liquid or paste, such as the liquids mentioned supra. The bottle 10 has an upper cylindrical neck 14. The neck 14 is characterized by a male thread 16 which extends upwards towards, but not to, the mouth of the bottle. The bottle mouth at the upper end of the neck 14 includes an outwardly extending annular flange 18, and the inner surface 20 of the outlet end of the neck is curved inwardly and downwardly away from the mouth of the bottle to form a spherical seat. The configuration and dimensions of the seat vary considerably, e.g. up to 1/16inch in dimension or deviation from sphericity, from bottle to bottle, this being an inherent problem for mass produced bottles which makes them difficult to seal with a ball, particularly where the contents of the bottle includes a volatile material as cosmetics products usually do.

A spherical ball 22 is mounted in the mouth of the bottle 10. The ball 22 is seated on the inner surface 20 and extends into the mouth of the bottle 10, however the diameter of the ball 22 is larger than the diameter of the mouth of the bottle 10, so that a major portion of the ball 22 protrudes from the bottle per se. The ball is made of a synthetic plastic which can be molded to any given configuration and dimension with a high degree of accuracy, e.g. within 0.002inches; however this accuracy does not enable a good seal to be made between the ball and the seat 20 because of the considerable variations that will be encountered in the configuration and dimensions of the seat. Even if the plastic is somewhat resilient a good seal cannot be ensured due to the substantial variations of the seat that are not feasible to control.

In accordance with the present invention, a substantially cylindrical ball retainer 24 is provided, to retain the ball in the mouth of the bottle when the assembly is in service and to seal the contents against evaporation or leakage when the bottle is closed. The retainer 24 composed of a resilient synthetic plastic, i.e. an elastomeric material such as a low density polyethylene, is mounted on the outlet end of the neck 14, with the middle portion of the retainer 24 being external to the flange 18. The retainer 24 is mounted on the neck 14 by providing an inwardly extending annular flange 26 at the lower end of the retainer 24. The flange 26 terminates with an inner dimension or diameter slightly less than the outer dimension or diameter of flange 18; thereby the flange includes an inner annular groove 27 which grips the flange 18. The flange 26 is disposed concentrically external to and contiguous with the neck 14 adjacent to and below the flange 18, to hold the retainer 24 on the neck 14. The inner end of the flange 26 is preferably curved to enable it more easily to be assembled on the bottle.

The upper end of the retainer 24 is characterized by the provision of a substantially frusto-conical extension having a frusto-conical outer surface 28 and an inner circular thin flexible lip 30 which is contiguous with the surface of ball 22 and far more flexible than the ball. Thus, the lip 30 is spaced away from the neck 14, and the upper end of the lip 30 spaced away from neck 14 has a diameter less than the diameter of ball 22 so that only a minor portion of ball 22 protrudes from retainer 24 and the ball 22 is retained in the mouth of bottle 10. The lip is located above the horizontal equator of the ball. The inner surface 32 of the upper frusto-conical extension of the retainer 24, which is contiguous with the ball 22, is preferably curved downwards and away from the point of contact of the lip 30 with the ball 22, so as to provide a concave surface which permits the ball 22 to rotate in service and which also permits the passage of a liquid film or coating from the body 12 of contents to the upper surface of the ball 22 as the ball is rotated by contact with a surface of the human body, as described supra.

The bottle 10 is provided with a closure cap 34 having a crown 36 and a skirt 38, the skirt 38 depending from the crown 36 and being formed with a lower female thread 40 which engages the male thread 16 to enable the cap 34 to be mounted on the neck 14. The cap 34 has an inner ball-sealing insert 42 in accordance with the present invention.

The insert 42 is generally cylindrical in configuration and is secured, as by friction fitting in the cap 34 adjacent to the crown 36. The insert 42 includes a crown 44 characterized by the provision of a central lower protuberance 46 which engages and is contiguous with the upper surface of the ball 22 when the cap is screwed home, so that the protuberance 46 presses the ball 22 towards the bottle 10 and thereby presses the ball 10 on the curved inner surface 20 (seat) of the neck 14. In this preferred embodiment of the invention, the protuberance 46 is provided with a central depression 48 so that the protuberance 46 has a uniform and substantially circular contact with the then upper surface of the ball.

Insert 42 is provided with a skirt 50 which depends from the crown 44. The skirt 50 terminates at a lower frusto-conical camming surface 52 aligned with the surface 28 of the retainer 24, so that when the retainer 24 is pressed downwards upon screwing the cap down, the circular lip 30 is flexed downwards and inwards against the surface of the ball 22, to provide positive closure sealing that is essentially hermitic as a result of the accurate shape of the ball and the flexibility of the lip. Thus, the present invention is characterized by a new mode of closure sealing of a roll-on dispenser bottle assembly, i.e., by the provision of a closure cap 34 which seals both by means of the protuberance 46 pressing the ball 22 downwards against the seat 20 (a sometimes imperfect seal but definite positional placement of the ball), and also by means of the camming surface 52 of the skirt 50 pressing against the frusto-conical surface 28 of retainer 24 to urge the lip 30 against the ball 22.

The insert 42 will usually be provided with external vertical serrations or ridges in the crown 44, e.g. ribs 58 (FIG. 3), or other means for holding the insert 42 in place in the cap 34. Other details of the insert 42 are shown in FIG. 1. It should be noted that the insert 42 is usually provided with upper projections 54 to position the insert 42 in the cap 34. A central projection 56 will usually extend upwards from the crown 44 of insert 42, to provide strength and rigidity to insert 42 and also to facilitate molding of the insert 42 which is usually composed of material comparable to the material of construction of the retainer 24, as mentioned supra.

Figure 3:
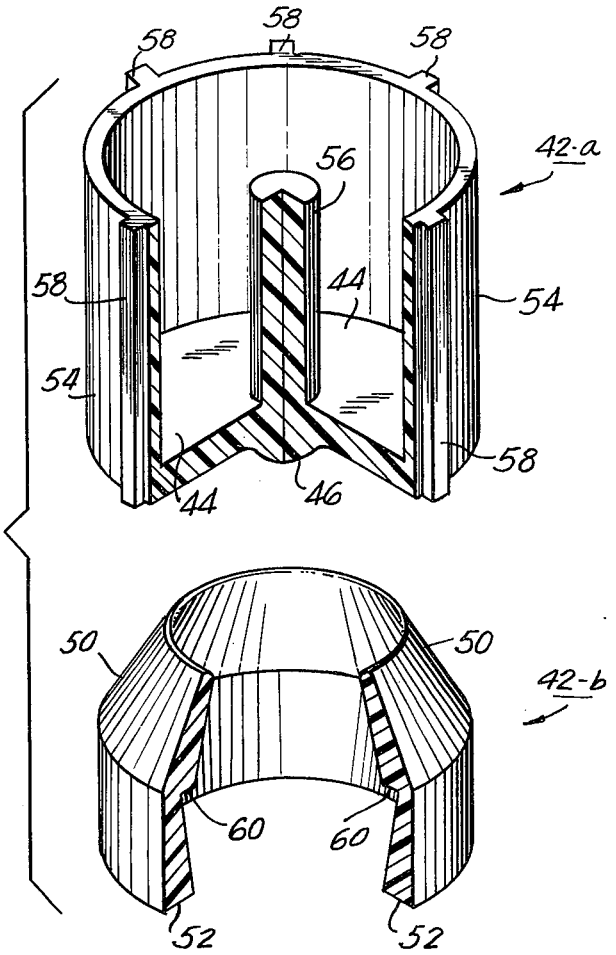
FIG. 3 is a sectional perspective view of an alternative embodiment of the insert for the closure cap, in which the insert is provided in two discrete pieces or parts.
Figure 4:
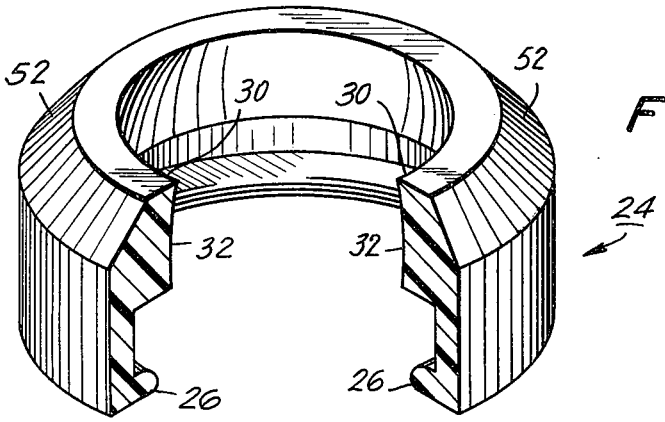
FIG. 4 is a sectional perspective view of the retainer of FIG. 1.

FIG. 3 illustrates an alternative embodiment of the invention in which the insert 42 is composed of two discrete parts or pieces 42-*a* and 42-*b*. The upper insert portion 42-*a* is provided with external vertical serrations or ridges 58, and the lower protuberance 46 is provided without a central depression. The inner surface 60 of the part 42-*b* bears against the lip 30 in service.

Numerous alternatives within the scope of the present invention, besides those alternatives mentioned supra, will occur to those skilled in the art. The bottle 10 may be of any suitable shape or form, thus bottle 10 may be cylindrical, or square or oval in cross-section, etc. Similar considerations apply to the cap 34. However, the cooperating portions of the cap 34 and the neck 14 will be cylindrical and coaxial. Finally, in some instances the retainer 24 may be mounted in the mouth of the bottle 10 by alternative means known to the art, however, the aspect of the present invention entailing dual or two-phase action of the cap insert 42, both by means of protuberance 46 and by means of surface 52 of skirt 50, will always be present to attain the improved closure concept of the present invention.

It thus will be seen that there is provided a roll-on ball dispenser assembly with closure cap which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense.

Having thus described the invention, there is claimed as new and desired to be secured by Letters Patent:

1. A dispenser bottle assembly with closure cap comprising a bottle, said bottle having a cylindrical neck with a circular mouth, said neck being provided with a male thread, a substantially cylindrical retainer, said retainer being mounted on the outlet end of said neck, a spherical ball, said ball being seated on the mouth of the neck under said retainer whereby a minor portion of said ball protrudes from said retainer and the ball is trapped between the neck and the retainer, said retainer having an extension terminating at an inner circular flexible lip adjacent the upper surface of said ball, the end of said lip which is spaced away from said mouth defining a circle having a diameter less than the diameter of said ball, and a closure cap, said closure cap having a crown and a skirt, said closure cap skirt depending from said crown and having a female thread at one end, said female thread engaging said male thread to mount said cap on said neck, said cap having an inner ball-seating central protuberance and an inner annular camming surface adjacent to said crown, said protuberance being in contact with the surface of said ball, whereby said protuberance presses said ball towards said bottle and thereby seats said ball in the mouth of said bottle, said camming surface depending from said crown and terminating in contact with said lip, whereby said circular lip is pressed against said ball to provide essentially hermetic closure sealing of said bottle.

2. The dispenser bottle assembly with closure cap of claim 1, in which the protuberance is provided with a central depression whereby the protuberance has a substantially circular contact surface with the ball.

3. The dispenser bottle assembly with closure cap of claim 1, in which the inner ball-seating central protuberance and the inner annular camming surface are portions of a separate inner ball-seating insert within said cap, said insert being disposed adjacent to said crown, said insert being provided with a crown, the inner ball-seating central protuberance depending from said insert crown, said insert being provided with a skirt, said insert skirt depending from said insert and terminating at the inner annular camming surface.

4. The dispenser bottle assembly with closure cap of claim 3, in which the insert crown and the insert skirt are discrete parts of the insert.

5. The dispenser bottle assembly with closure cap of claim 1, in which the inner surface of the extension of the retainer contiguous with the ball is curved to provide a concave surface.

* * * * *